United States Patent [19]

Balligand et al.

[11] 4,196,531

[45] Apr. 8, 1980

[54] INDEPENDENT UNIT FOR THE COLLECTION AND UPWARD TRANSFER OF NODULES WHICH REST ON AN UNDERWATER BED

[75] Inventors: Pierre L. Balligand, Sceaux; Pierre Biancale, Gif-sur-Yvette; Jean-Paul Jacquemin, Orsay; Michel Rommens, Chevreuse, all of France

[73] Assignee: Commissariat a l'Energie Atomique, Paris, France

[21] Appl. No.: 880,034

[22] Filed: Feb. 22, 1978

[30] Foreign Application Priority Data

Feb. 25, 1977 [FR] France ..... 77 05596

[51] Int. Cl.[2] ..... B66C 3/02; E02F 3/44

[52] U.S. Cl. ..... 37/54; 37/56; 37/71; 37/183 R; 37/DIG. 8; 73/425.2

[58] Field of Search ..... 37/54, 56, 71, DIG.8, 37/183 R, 183 A, 186; 73/425.2, 425.6; 175/5, 6

[56] References Cited

U.S. PATENT DOCUMENTS

| | | | |
|---|---|---|---|
| 3,572,129 | 3/1971 | Walthier et al. | 37/56 UX |
| 3,885,440 | 5/1975 | Rossfelder | 73/425.2 |
| 3,996,678 | 12/1976 | Amann et al. | 37/183 R |
| 3,999,313 | 12/1976 | Andrews | 37/DIG. 8 |
| 4,116,069 | 9/1978 | Lezgintser et al. | 37/71 X |

FOREIGN PATENT DOCUMENTS

| | | | |
|---|---|---|---|
| 457660 | 3/1975 | U.S.S.R. | 37/71 |

*Primary Examiner*—Clifford D. Crowder

*Attorney, Agent, or Firm*—Pearne, Gordon, Sessions

[57] ABSTRACT

The end of at least one cable is connected to a float and the other end exerts a tractive effort on one or a number of collecting vehicles which land on the bottom at predetermined points with respect to the point of landing of the ballast which is provided with a pile, anchored in the sea bed, then freed from the float and the vehicle. Means initially secured to the ballast and then detached therefrom serve to convert the upward motion of the float to a displacement of the collecting vehicle along the sea floor.

7 Claims, 21 Drawing Figures

Figure 1A:
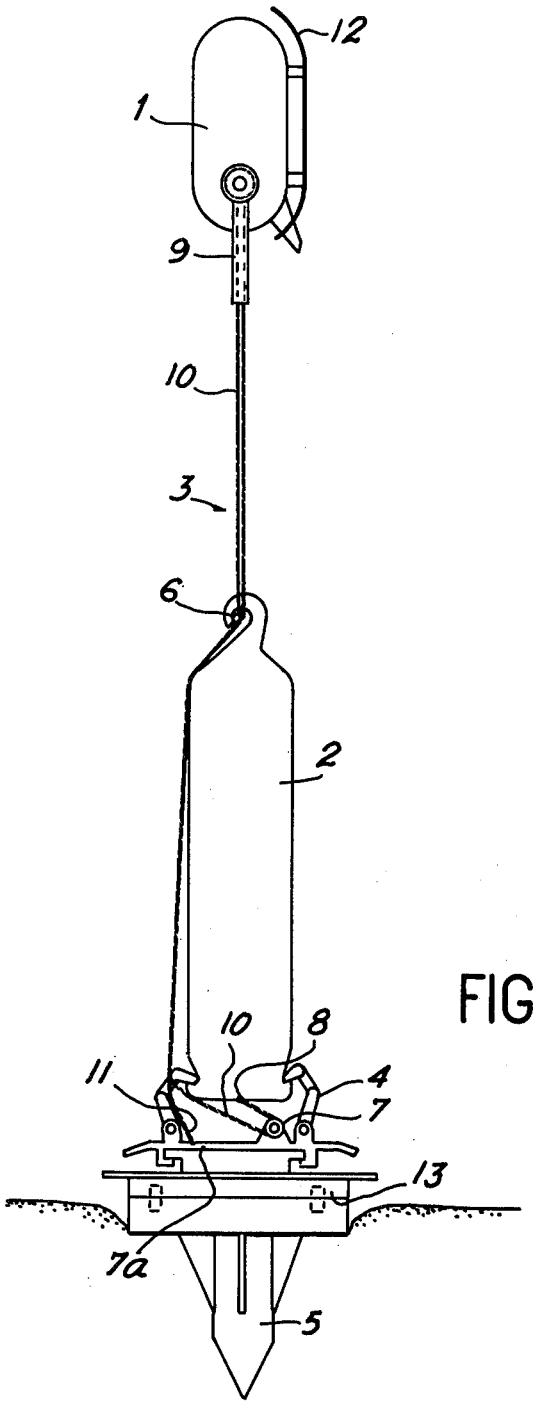

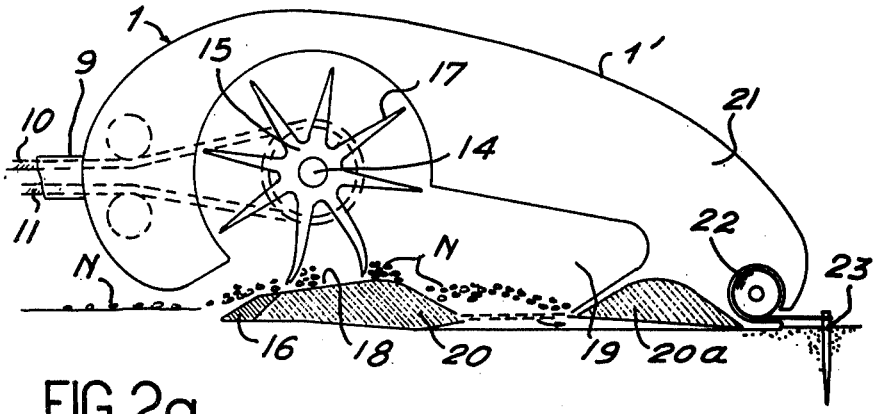
FIG. 2a
FIG. 2b
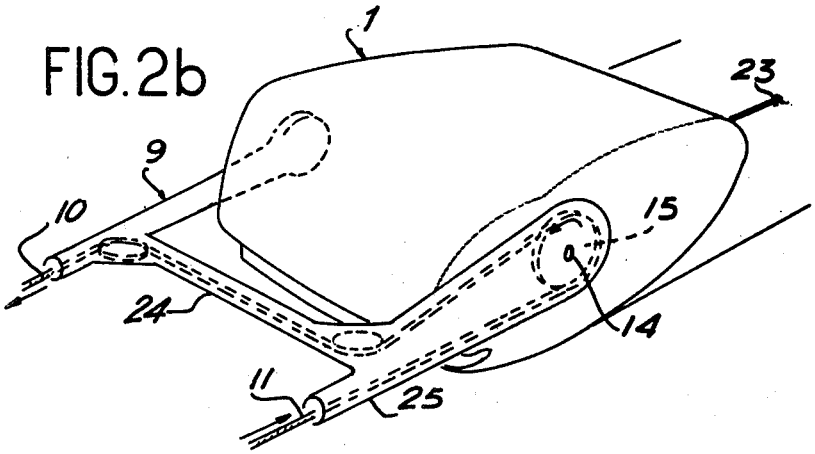
FIG. 3b
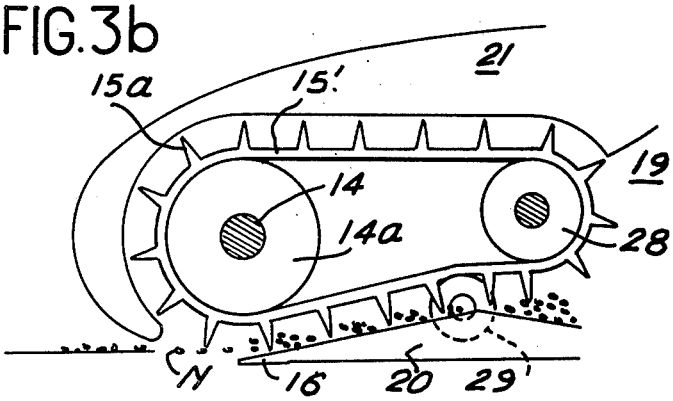

INDEPENDENT UNIT FOR THE COLLECTION AND UPWARD TRANSFER OF NODULES WHICH REST ON AN UNDERWATER BED

This invention relates to an independent unit for the collection and upward transfer of objects resting on an underwater bed.

In more precise terms, the present invention is concerned with a unit for collecting objects in deep sea beds and especially polymetallic nodules. The expression "independent unit" is understood to mean that, immediately after immersion, the unit is no longer connected mechanically either to land or to a surface support.

A number of different methods for collection and upward transfer are already known. They are derived from conventional dredging processes extended to the particular application of very deep sea beds. Another known type of system is designed to collect samples by utilizing energy which is conveyed down to the bottom of the sea in order to permit displacement of collecting units on the sea floor. And finally, it is a known practice to employ sampling devices for collecting over a very limited area of the order of one square meter or even for carrying out a virtual point-collection operation, these devices being derived from core-drilling samplers.

Sampling by means of machines which are continuously towed from the surface by means of a cable gives rise to considerable operational difficulties, especially when moderate quantities of nodules have to be collected, for example quantities of the order of 50 to 100 kg. If said cable also supplies the power required to assist the movements of the vehicle along the sea floor, this only serves to introduce further disadvantages as a result of both capital cost and weight of the traction and/or electric cable. A number of free samplers are already known and among these can be mentioned the device which is described in U.S. Pat. No. 3,572,129 and which operates in much the same manner as surface-type clamshell buckets. The disadvantage of this system, however, lies in the fact that samples are collected only at the point reached by the bucket on the sea floor and that the bucket is sometimes liable to jam in the half-closed position, thus allowing part of the collected sediments to escape.

Another sampler as disclosed in French Pat. No. 2,193,480 can also be mentioned and again suffers from the disadvantage of collecting samples only at the point of the sea floor on which it comes to rest.

The unit in accordance with the invention overcomes the drawbacks of captive devices of the passive or power-operated type as well as the disadvantages of the free devices described in the foregoing. The unit under consideration accordingly makes it possible to carry out the collecting operation, not locally at a single point but over a given area of the sea floor and can be constituted by a plurality of collecting vehicles.

The precise aim of the invention is to provide an independent unit for the collection and upward transfer of nodules resting on an underwater bed, the unit being distinguished by the fact that it comprises:

at least one collecting vehicle, at least one ballast, flotation means, at least one means for conversion of the direction of displacement, said flotation means being secured to the end of at least one cable, the other end of the cable or cables being intended to exert a tractive effort on said vehicle or vehicles either directly or by means of a transmission element and said conversion means being in cooperating relation with said cable or cables in order to convert the upward motion of said float to a displacement of said vehicle or vehicles along the sea floor, said means being secured to said ballast and then detached therefrom as required, said ballast being provided with means for anchoring in the sea bed, means for securing the assembly constituted by the float, the ballast, said conversion means and said vehicles until said assembly reaches the sea floor, means for detaching said float from the ballast when said ballast has reached the sea floor, means rigidly fixed to said vehicle or vehicles and to said float for causing said vehicle or vehicles to land on the sea floor at predetermined points with respect to the point of landing of said ballast, means for detaching said vehicle or vehicles and said conversion means from said ballast.

In accordance with a first embodiment of the collecting unit, the float is secured to the ballast which is distinguished by the fact that a form of pile serves to effect anchoring at the time of insertion in the sea bed at a sufficiently high speed of landing. By virtue of the speed acquired as a result of the excess specific weight of the anchoring pile with respect to the lifting force of the float, a collecting vehicle having a low specific weight in the water is drawn at the end of a cable by said float and pile-ballast assembly. As it reaches the bottom, the pile penetrates into the sea bed and thus ensures subsequent anchoring while remaining attached to the float. As the cable slackens, so the streamlined shape of the vehicle and the distribution of its center of buoyancy cause the cable to move away until tension is restored and the cable is deposited at a suitable distance from the anchoring pile. Release of the float is initiated and then exerts a tractive effort on the vehicle by means of said cable and a pulley which is attached to the pile. The vehicle then performs a collecting operation. On completion of the desired distance of travel or after a given length of time, the pulley which is fixed on the anchoring pile is detached and the float then draws upwards either all or part of the collecting vehicle, thus raising to the surface the sediments which have been collected and the main part of the collecting vehicle.

In accordance with a second embodiment, the free sampler comprises at least one vehicle attached to a float by means of a cable and secured to a vertical arm pivotally mounted on a frame which is fixed on a ballast, means for causing the arm or arms to swing radially from the vertical position to the horizontal position as soon as the ballast has come to rest on the sea floor. The vehicle or vehicles can thus be located in the collecting position at a distance imposed by their arm. The sampler further comprises means for releasing the float, thus making it possible as a result of the action of its lifting force to ensure linear upward motion of the vehicle or vehicles by virtue of the means for conversion of the direction of displacement as well as collection and storage of sediments. Means are also provided for jettisoning the ballast, thus initiating upward motion of the assembly which is constituted by the loaded vehicle or vehicles, the frame, the arms and which is connected to the float by said cable and said conversion means.

In accordance with a third embodiment, the free sampler comprises at least one vehicle connected by means of at least one pivotally mounted vertical arm to a frame fixed on a ballast, a device for displacing the arm or arms in pivotal motion from the vertical position to the horizontal position as soon as the ballast has come to rest on the sea floor, with the result that the vehicle can be located in the collecting position. The sampler further comprises means for releasing the float in order to permit vertical action of its lifting force, means for converting said vertical force transmitted by a cable to a movement of rotation of the arms and of the vehicles about the ballast, for the collection and storage of sediments. Means are also provided for jettisoning the ballast, thus initiating upward motion of the assembly constituted by the loaded vehicles, the frame, the arms which are connected to the float by means of said cable and the conversion means aforesaid.

In the operation of these three alternative embodiments of the collecting unit, the following stages can be distinguished:

simultaneous immersion of the unit and of its ballast, laying and anchoring of the ballast at the bottom of the sea followed by the movement of placing of the collecting vehicle or vehicles on the sea floor at a predetermined distance from the ballast, automatic initiation of displacement of the collecting vehicle or vehicles by suitable means along a rectilinear or circular path in order to cover a predetermined collection area by virtue of the energy produced by the tractive effort exerted on the cable by the float.

Figure 3A:
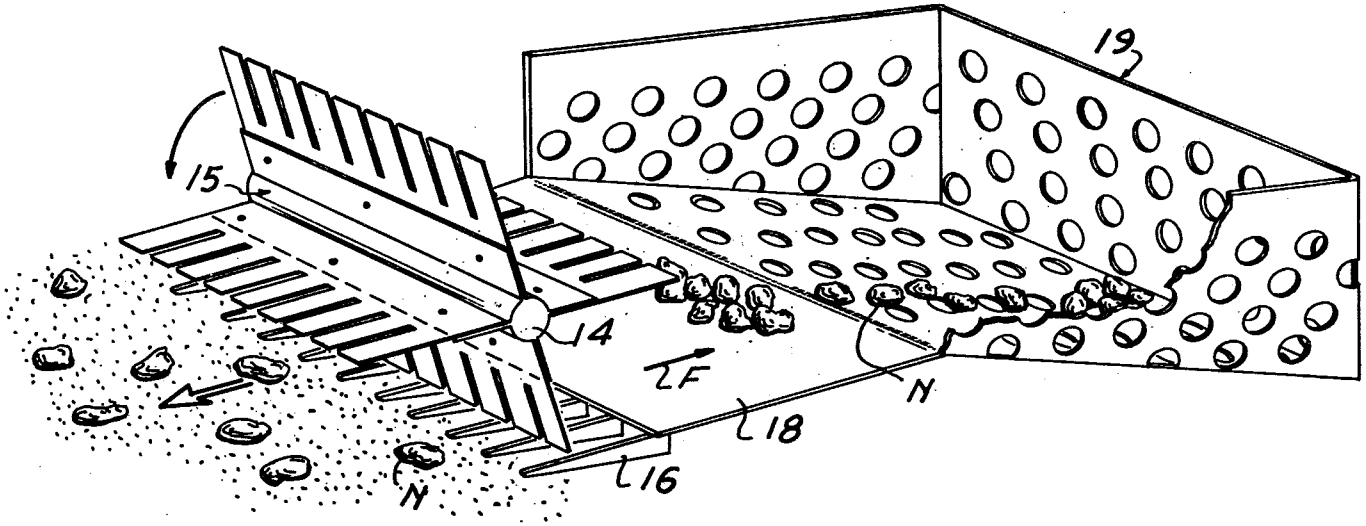

A more complete understanding of the invention will in any case be obtained from the following description of three embodiments which are given by way of example and not in any limiting sense, reference being made to the accompanying drawings, wherein:

FIGS. 1*a* to 1*d* show the different stages of operation of a first embodiment of the collecting unit;

FIGS. 2*a* and 2*b* are detail views showing one embodiment of a collecting vehicle;

FIG. 3*a* is a view in perspective showing a preferred embodiment of the interior of the collecting vehicle (the vehicle body having been removed);

FIG. 3*b* is a part-sectional view of an alternative form of construction of the collecting vehicle shown in FIGS. 2*a* and 2*b;*

Figure 8A:
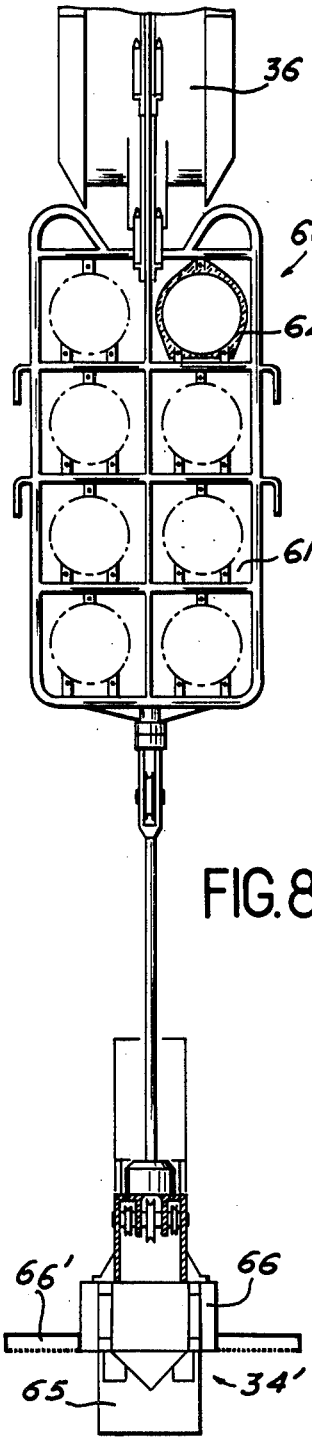
Figure 8B:
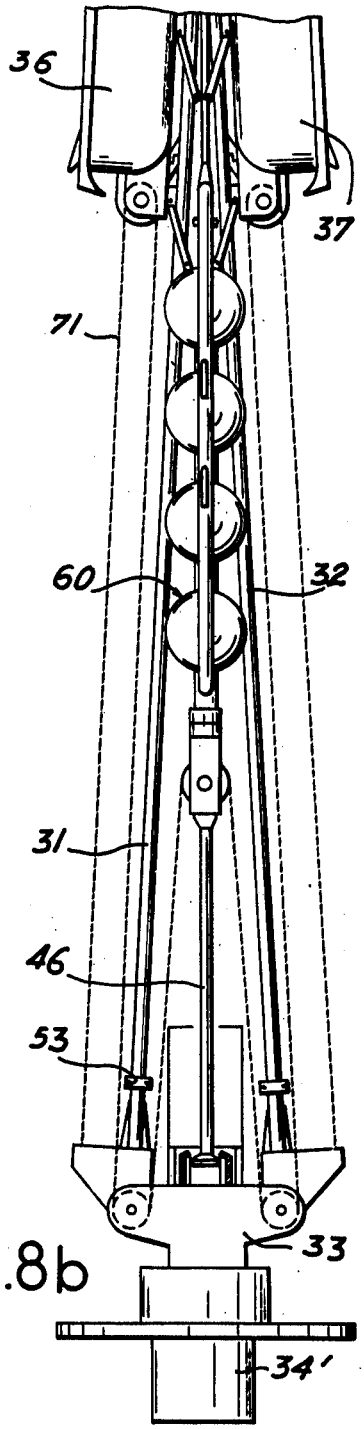
Figure 9:
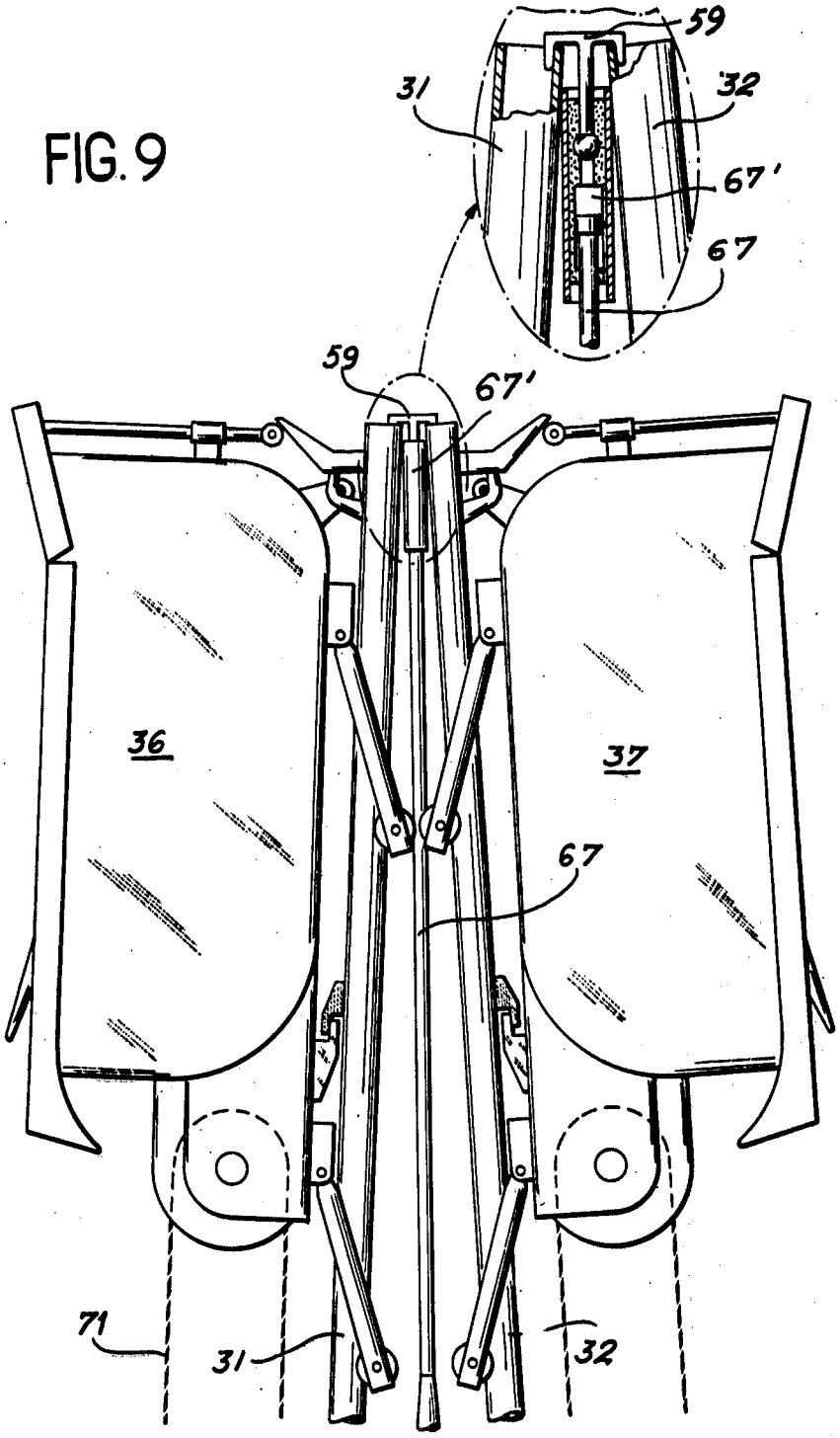
Figure 10A:
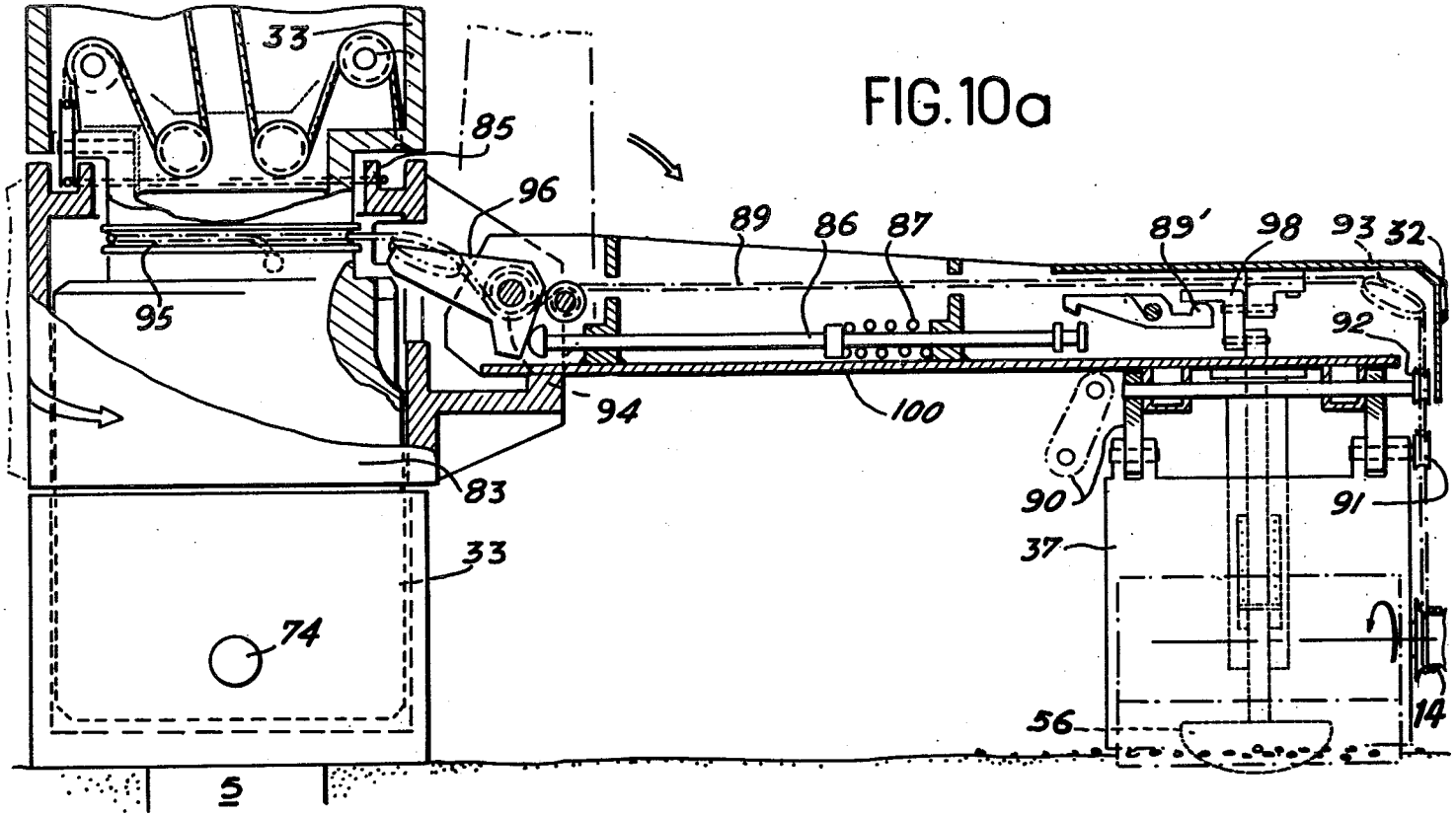
Figure 10B:
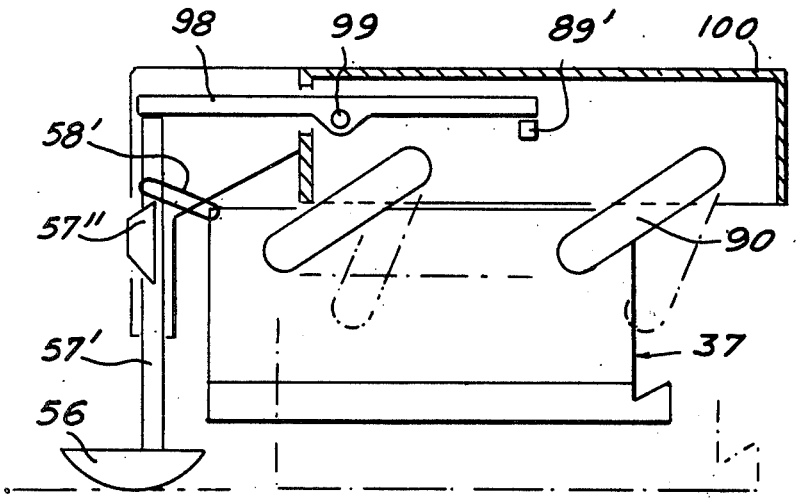
Figures 11, 12:
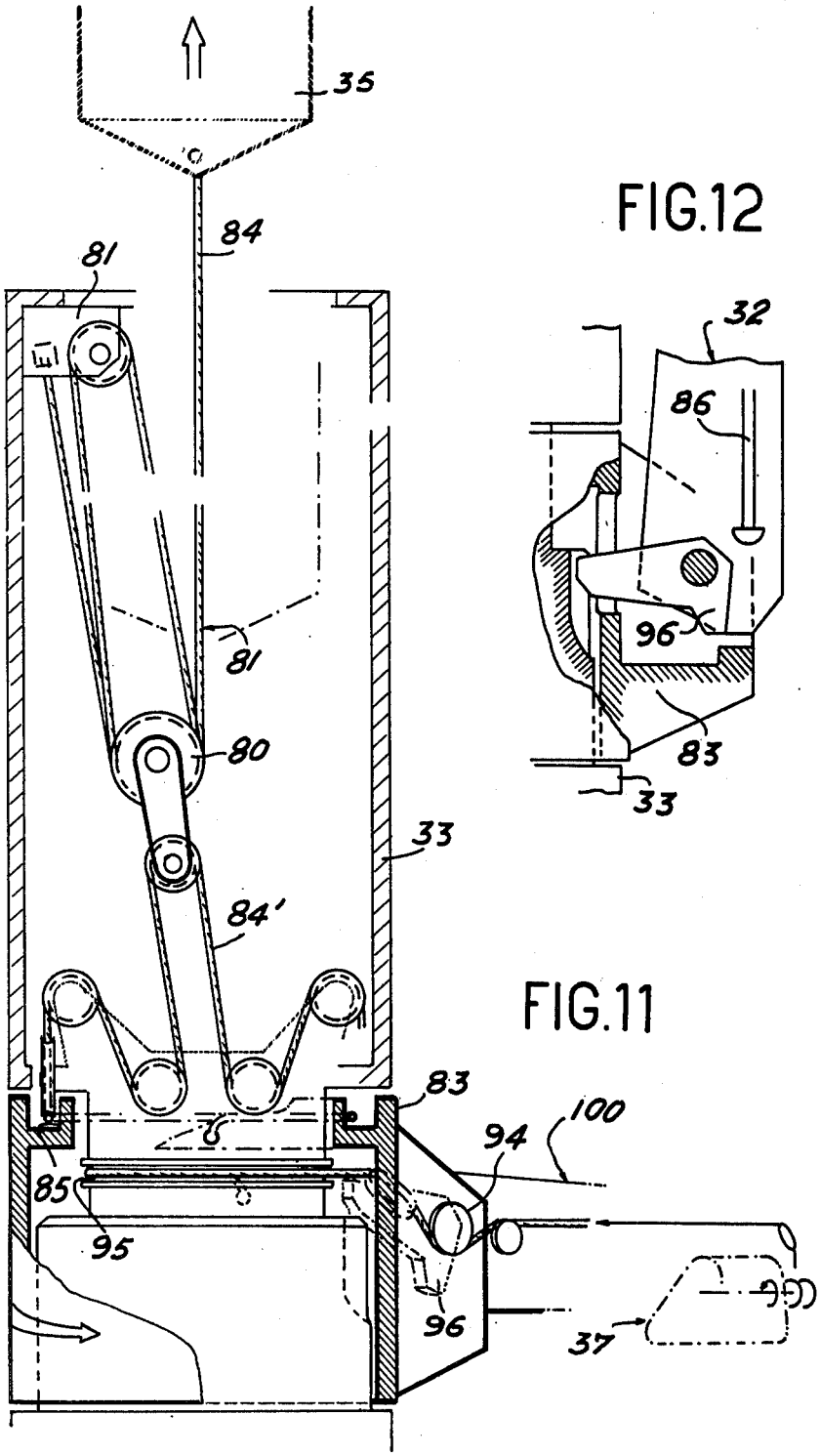
Figure 13:
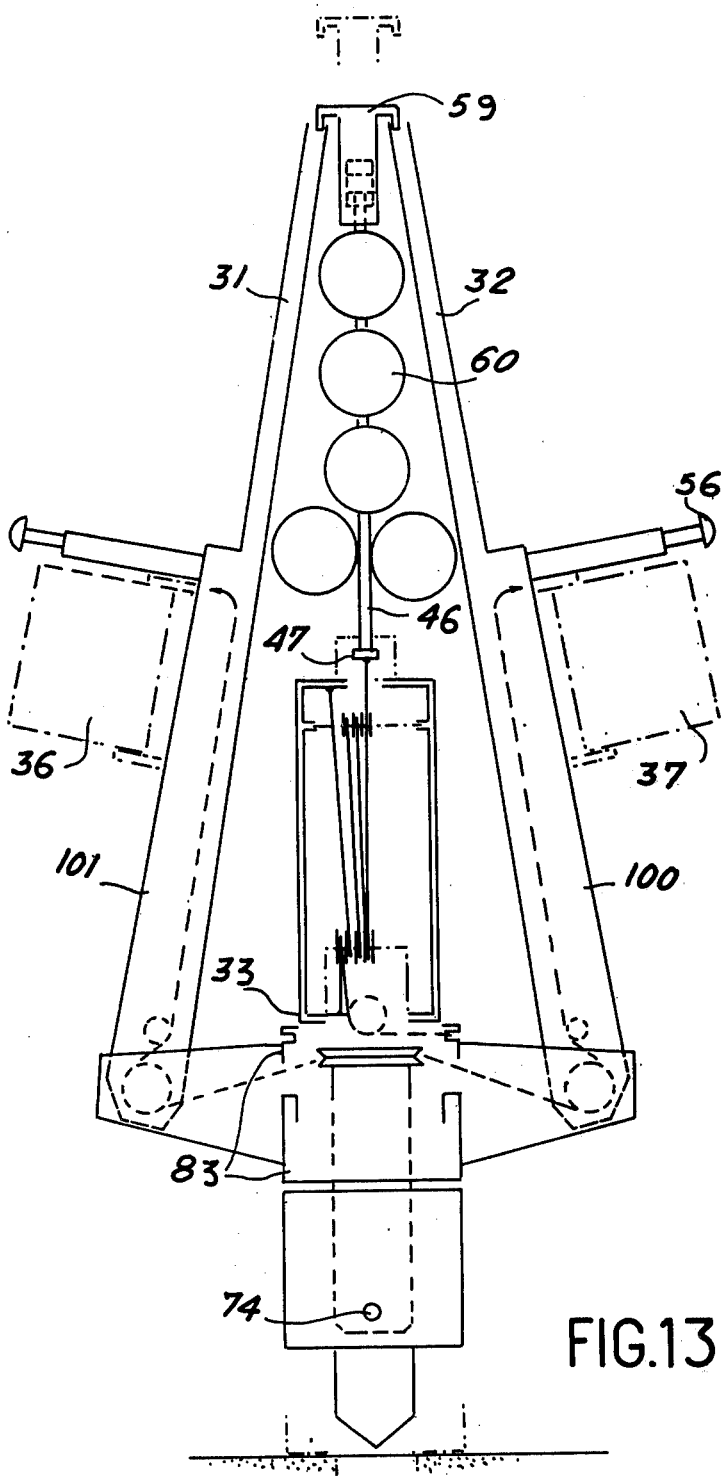

FIGS. 4*a* to 4*d* show the different stages of operation of a second embodiment of the collecting unit according as this latter is provided with either one or two articulated arms;

FIGS. 5, 6, 7*a* and 7*b* are views showing the collecting unit in accordance with the second embodiment;

FIGS. 8*a*, 8*b* and 9 are views showing an alternative form of the second embodiment;

FIGS. 10*a*, 10*b*, 11, 12 and 13 are views showing a third embodiment of a collecting unit in which articulated arms are again provided but can be driven in rotation; FIGS. 10*a* and 10*b* show respectively in longitudinal section and in transverse section an arm for guiding the collecting vehicles; FIG. 11 shows the cables for initiating movements of rotation of the arm or arms of the unit; FIG. 12 shows the arrangement adopted for locking an arm onto the body or frame of the unit; FIG. 13 shows the complete unit in the position of downward travel.

The four drawings of FIG. 1 show a first embodiment of the invention. FIG. 1*a* illustrates the unit which is anchored in the sea bed and is still in the downward-travel position; FIG. 1*b* shows the approach of the vehicle after depositing and jettisoning the first ballast; FIG. 1*c* shows the vehicle during operation, said vehicle being displaced as a result of the tractive force exerted by the float; FIG. 1*d* shows the upward return of the unit as a whole after jettisoning of the second ballast.

FIG. 1*a* illustrates the collecting vehicle 1 which is connected to the float 2 by means of the cable 3. The float is in turn connected by means of releasable members 4 to a ballast 5 designed in the form of a point-bearing pile which is subsequently intended to have an anchoring action when said ballast is abruptly deposited on the sea floor. In more precise terms, the releasable member 4 is fixed on an upper plate 13 which is also releasable with respect to the ballast 5 proper in the form of a pile. The cable 3 is attached to the top of the float 2 by means of a jettisonable element 6 or cable-release catch and then passes around a pulley 7 on the top end of the anchoring pile 5 before being attached at 8 to the lower end of the float 2. The specific weight of the ballast 5 is approximately equal to double the value of buoyancy of the float 2 whilst the vehicle 1 itself has a low specific weight underwater. The speed attained during downward travel of the unit is such that the resistance of the vehicle 1 to downward motion has the effect of applying tension to the cable 3 until the moment of slowing-down of the unit.

Figure 1B:
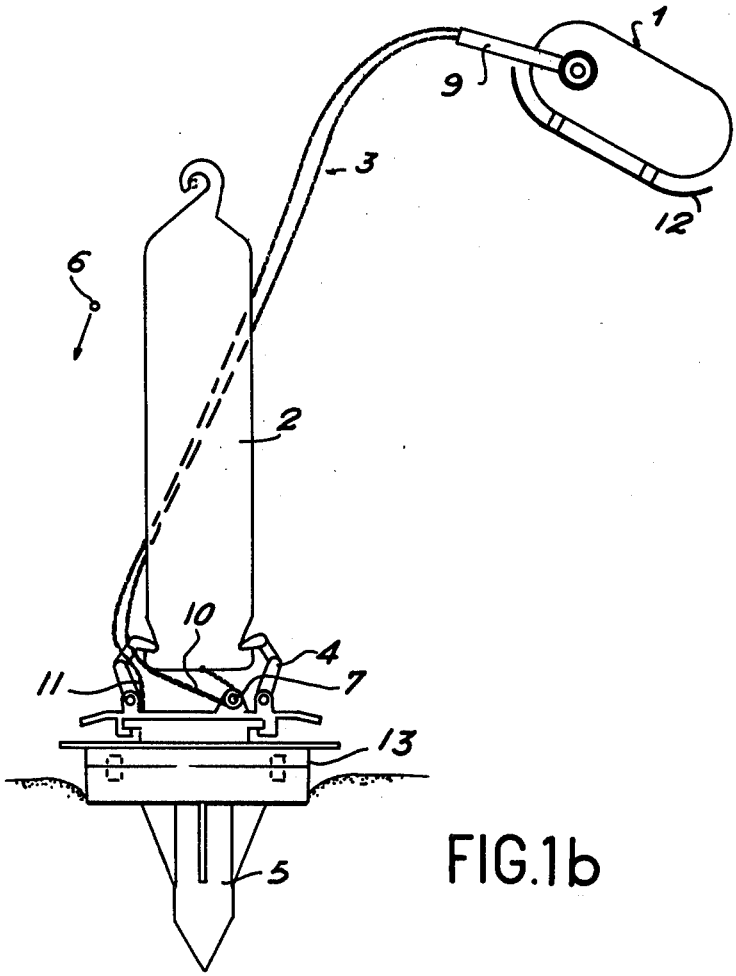

It is apparent from FIG. 1*b* which shows the unit immediately after penetration of the anchoring pile 5 into the low-resistance surface of the sea bed that the decrease in tension of the cable 3 results in detachment of the catch 6, thus releasing said cable 3 which is now connected only to the float 2 by means of the pulley 7 located at the top end of the anchoring pile 5. A stirrup 9 permits free pivotal motion of the collecting vehicle 1 with respect to the point of attachment of the cable. Moreover, the center of gravity is located beneath the center of flotation. The vehicle thus progressively assumes a horizontal position and, as a result of its kinetic energy which produced a downward displacement under the action of its initial vertical velocity, the vehicle consequently follows a path which brings it into contact with the sea floor when the cable 3 is almost fully extended, that is, at a point which is remote from the float 5. In the event that tension is applied to the cable 3 prior to contact with the sea floor, the low specific weight of the vehicle 1 would in such a case result in smooth landing on the sea floor.

Figure 1C:
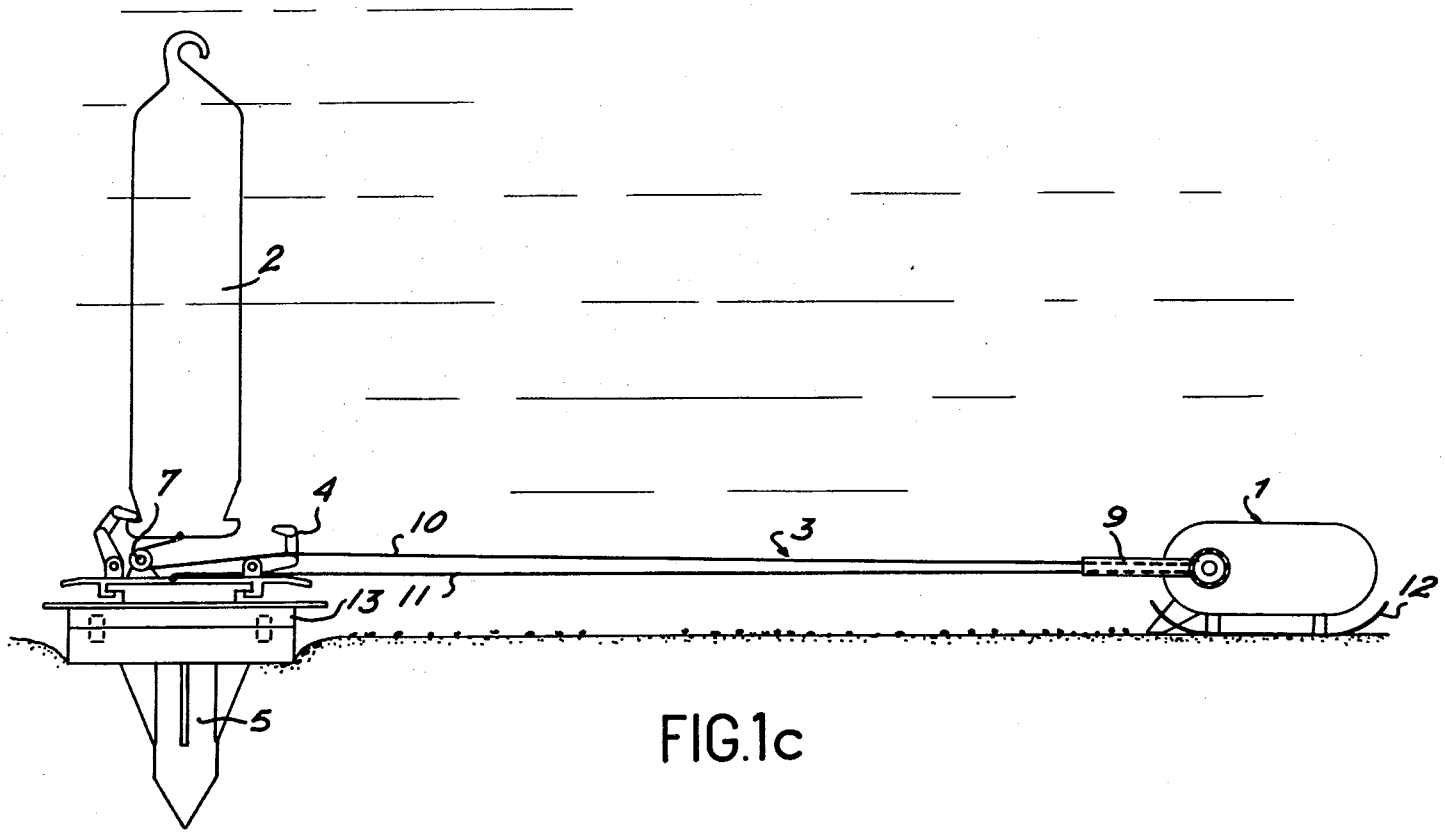

FIG. 1*c* shows the following operation which takes place after landing of the collecting unit 1. Time-controlled tripping of the float 2 results in release of this latter from the ballast 5 followed by upward motion and traction of the cable 3 which is attached to the lower end of said float at 8. The tractive effort exerted on the cable which is oriented by means of the stirrup 9 produces a tractive effort on the vehicle 1 which moves towards the anchoring pile 5. It can thus be understood that the pulley 7 has the intended function of converting the vertical displacement of the float 2 to a displacement of the vehicle 1 (or vehicles 1) along the sea floor. As will be explained hereinafter, this tractive effort is not directly sufficient to produce the displacements of a collecting vehicle and the efforts which are required for the collecting operation. As can be seen in FIG. 1*c*, the cable 3 below the pulley 7 which is fixed on the anchoring pile 5 is reeved in at least two lengths 10 and 11 which are nevertheless guided by the stirrup 9 and exert at least a double traction on the collecting vehicle 1 which rests on its skis 12 during this displacement.

Figure 1D:
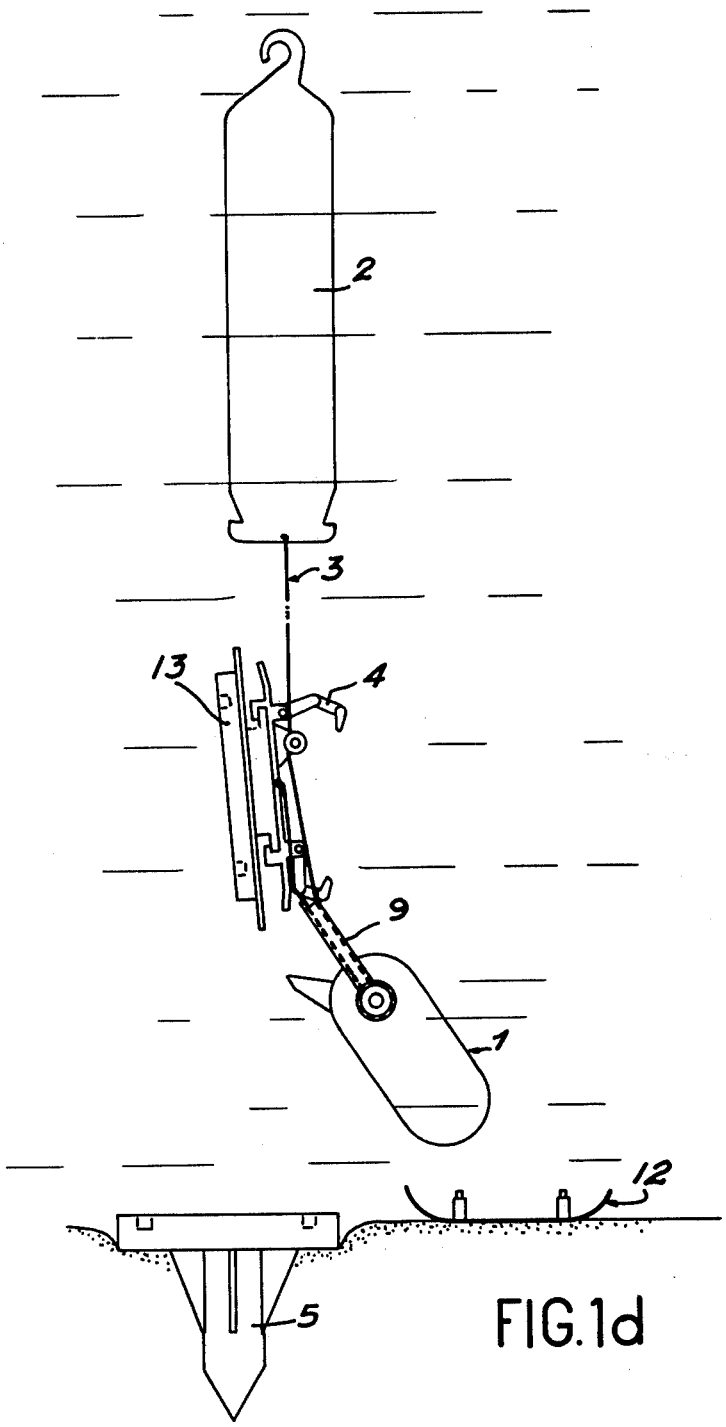

From FIG. 1*d* it is apparent that, at the end of the collecting operation or at all events at the end of a period of time defined by a timing system or by a predetermined distance of travel (counter 22), the upper portion of the ballast 5 is detached from the anchoring pile proper together with the pulley 7 and the point of attachment 7*a* of the reeved cable and that the unit moves upwards under the action of the sufficient lifting force of the float 2. Thus the float draws with it the main portions of the collecting vehicle 1 as shown in the figure whilst the skis 12 which constitute a secondary ballast are abandoned on the sea floor and the useful load or in other words the result of the collecting operation is carried upwards by the collecting vehicle.

In this embodiment, it can readily be understood that the means for conversion of direction are constituted by the pulley 7 which is rigidly fixed to the platform 13 whilst the means for causing the vehicle or vehicles aforesaid to land on the sea floor are provided by the element 6 or cable-release catch in the position of the center of gravity of the vehicle with respect to its center of flotation and to a certain extent by the hydrodynamic streamlining of vehicle bodies.

As shown in FIG. 2*a*, the collecting vehicle which is constructed of lightweight material such as plastic material reinforced with glass fiber, for example, and made up of a vehicle body 1' of streamlined shape as illustrated in profile in this figure is so designed that the ventral portion of said vehicle can rest on the sea floor or be supported thereon by means of skis (not shown in the figure). The stirrup 9 is pivotally mounted on a shaft 14 which is rigidly fixed to the vehicle body. As has already been seen in FIG. 1, this permits relative pivotal movements of the assembly of cable-lengths 10, 11 and of the vehicle body 1'. A flexible-blade wheel 15 mounted on the same shaft 14 within the interior of the vehicle body 1' provides mechanical assistance for collecting the nodules N shown on the sea floor, said nodules being dislodged from the clay bottom by means of teeth 16 which are shown in profile. The flexible blades such as the blade 17 of the wheel 15 serve to transfer the nodules along the inclined plane 18 to a storage cavity 19 provided within the vehicle body 1'. In these ventral portions of the vehicle, a ballast designated by the references 20 and 20*a* in FIG. 2*a* takes part in the landing of the vehicle on the sea floor at the time of free fall in the correct direction whilst the portion 21 of the vehicle is provided with flotation elements. A pulley which is not shown in this figure serves to drive the blade wheel 15 by means of the relative displacement of the two lengths of cable 10 and 11, thus providing the traction reeving system. To this end, several turns of the cable 3 are passed around the pulley (not shown) in order to obtain the friction drive required for driving the blade wheel 15. Behind the vehicle, a device for recording the distance of travel is provided by means of a paying-out drum 22 and a spike 23 which is inserted in the sea bed as soon as the vehicle comes into contact. The drum then pays-out a wire which is attached to the spike, provision being made for a potentiometer associated with the paying-out drum 22 and with a recording device (not shown in the figure). This system also makes it possible to initiate a movement of upward return after a suitable displacement and permits subsequent measurement of the distance travelled by the vehicle along the sea floor.

FIG. 2*b* shows in detail the arrangement of the lengths of cable 10 and 11 on the stirrup 9 and also shows the pulley 15 of the blade wheel which is designated by the same reference numeral (the body of the vehicle 1 which is intended to pivot freely with respect to the stirrup 9 is shown in a dotted line in the figure). It is seen that the two lengths 10 and 11 are maintained at a distance from each other, thus reducing any potential danger of jamming of the assembly of two cable-lengths in the event of twisting. A guide tube 24 transfers the cable length 10 from its point of exit located towards the right-hand side of the vehicle to the top portion of the pulley 15 located on the left-hand side whilst a second rectilinear guide tube 25 serves to guide the cable length 11. The relative displacement of said second cable length with respect to the vehicle is an entrance movement whilst the cable length 10 carries out an exit movement; the length 11 is clearly fixed with respect to the sea floor and is attached to the upper plate 13 of the anchoring pile.

FIG. 3*a* is a view in perspective in which the structure of the collecting assembly of the vehicle is shown in detail. This assembly is formed of tines 16 which penetrate into the sediment and the spacing of which is slightly smaller than the dimension of the objects to be collected, namely the polymetallic nodules N in the example under consideration. The blade wheel 15 having a shaft 14 is provided with flexible blades 17 placed directly above the tines 16 in order to pick-up the objects which have been dislodged from the sea-bed sediment by the tines. The blades facilitate transfer of the objects along the inclined plane 18 in the direction of the arrow F and then along the slight downward slope within the storage cavity 19. It is apparent that the perforated structure of the cavity wall ensures maximum separation of said objects from any clay which may have continued to adhere thereto since it permits good circulation of water which is in turn enhanced by the movement of rotation of the blades 15. It can readily be understood that the assembly shown in FIG. 3*a* can in turn be provided with a possibility of relative displacement within the vehicle 1 in order to prevent jamming on a large object or in order to adjust to an optimum value the degree of penetration of the tines 16 into the sediment which supports the objects N to be collected.

FIG. 3*b* shows an alternative embodiment of the collecting device. This device comprises a flexible belt 15' fitted with blades 15*a* for ensuring optimized pick-up of objects at the tips of the tines 16 and continuous rearward displacement of these latter from the inclined plane 18 to the storage zone 19. To this end, instead of being carried by a single blade wheel having a shaft 14, the flexible belt 15' is carried by a first pulley which is equivalent to the wheel 15 and designated by the reference 14*a*, then passes over a second set of pulleys 28. The belt is maintained in the vicinity of the summit of the inclined plane 18 by means of a set of lateral rollers shown in dashed outline and designated by the reference numeral 29. The arrangement just mentioned has the advantage of ensuring better rearward displacement of collected objects and better filling of the storage volume 19. This in turn makes it possible to increase the sampling capacity of this assembly with respect to the assembly shown in FIG. 2*a*.

Figure 4:
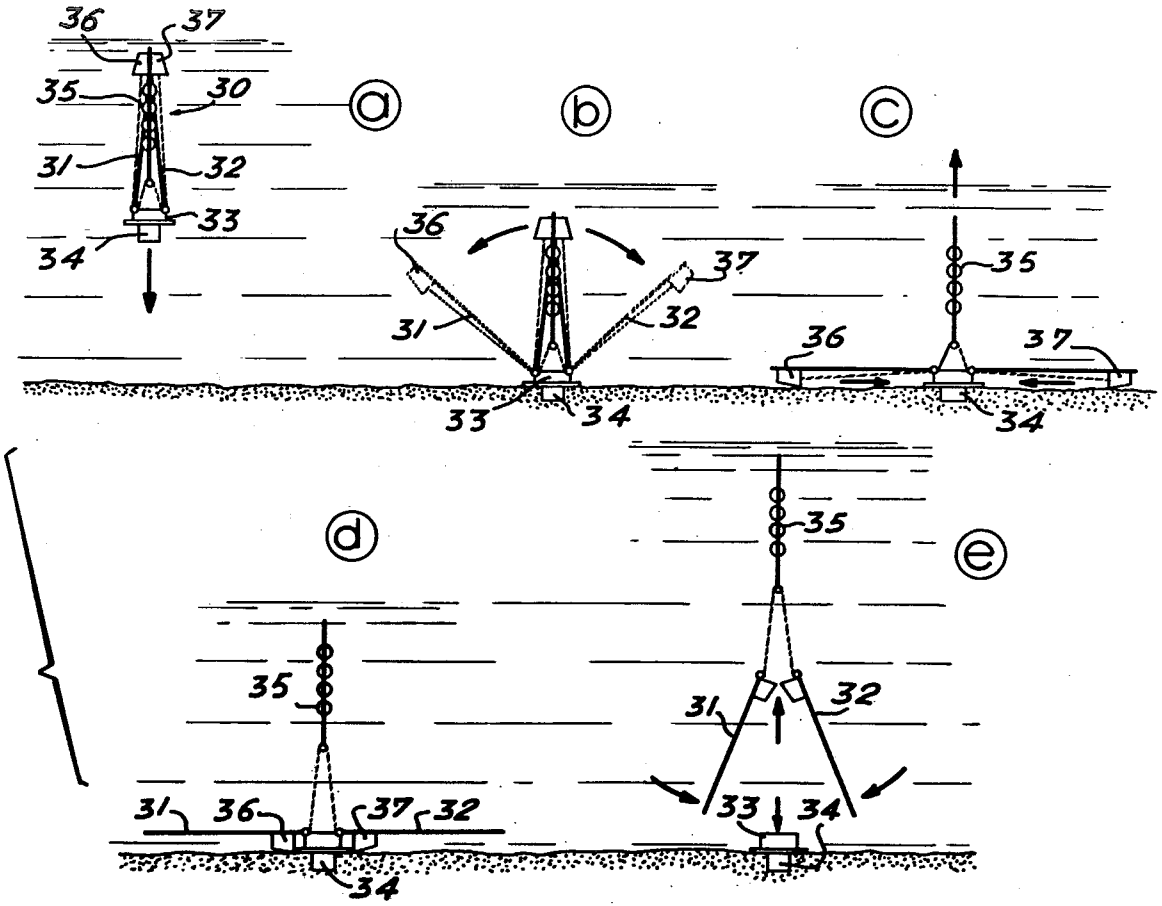

FIG. 4 illustrates the different sequences of operation of a second embodiment of the device. In this embodiment, the device comprises two arms 31 and 32 pivotally mounted on a support frame 33 which is rigidly fixed to a ballast 34. The collecting vehicles 36 and 37 are attached to the ends of the articulated arms 31 and 32.

Figure 5:
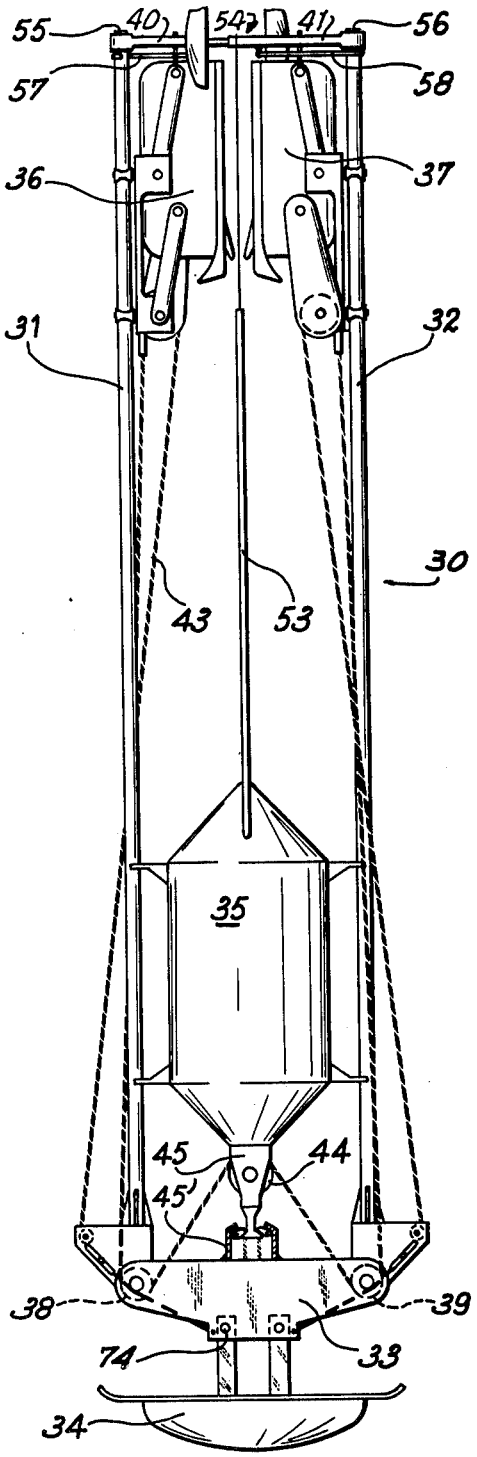

In FIGS. 4*a* and 5, the unit 30 as a whole is folded back, the two articulated arms are in the semi-vertical position and the ballast draws the assembly downwards. In accordance with the invention, the float 35 located between the two articulated arms has a degree of buoyancy which is lower than the specific weight of the assembly which comprises in particular the ballast 34. As the unit lands on the sea floor which is shown in FIG. 4*b*, penetration of the ballast takes place while the support frame 33 remains slightly above the level of the sea floor. The two articulated arms 31 and 32 are then released and caused to move outwards slowly by the low value of specific weight of the two collecting vehicles 36 and 37.

The two vehicles 36 and 37 which rest on the sea floor on completion of this movement are shown in FIG. 4*c*. Release of the float 35 with respect to the ballast 34 produces a tractive force on the cables (not designated by reference numerals in the figure) and this has the effect of drawing the two vehicles together (said vehicles having been described earlier with reference to FIGS. 2 and 3). The vehicles which are guided by the articulated arms move progressively towards the support frame 33 which is rigidly fixed to the ballast 34. At the end of this operation which is shown in FIG. 4*d*, the two collecting vehicles are close to the assembly 33, 34, whereupon the articulated arms are released with respect to the assembly 33, 34. This release is carried out either by completion of the collecting movement or by time-control for recovery of the essential parts of the unit in the event of either total or partial failure.

It can accordingly be seen from FIG. 4*e* after this release that the articulated arms move upwards under the action of the float 35, thus drawing the two vehicles and their contents to the surface, the abandoned parts being constituted by the ballast 34 and the mechanisms or components for attaching the support frame 33.

FIG. 5 is a detail view showing a sampler 30 of a type similar to that shown in FIG. 4. This sampler is equipped with two articulated arms 31 and 32 which are connected to the sampler frame or body 33 to which a ballast 34 and a float 35 are also attached.

The two articulated arms 31 and 32 of FIG. 5 each carry a collecting vehicle 36, 37. Said arms are pivoted to the support frame 33 by means of hinge-pins 38 and 39 and joined together at the level of their end members 40 and 41 which serve as supports for said arms on the sea floor on which the collecting operation is intended to take place. The float 35 is connected to the frame 33 of the sampler 30 by means of a hook shown in detail in FIGS. 7*a* and 7*b* and to the collecting vehicles 36, 37 by means of a cable 43 which is connected to each vehicle, passed around the hinge-pins 38 and 39 and over a pulley 44 which is provided at the lower end of the float 35.

The connection between the float 35 and the frame 33 is effected by means of a conical projecting portion 45 which is provided at the lower end of the float 35 and cooperates with an opening 45' of the frame 33, thus constituting a controllable coupling means.

Figure 7A:
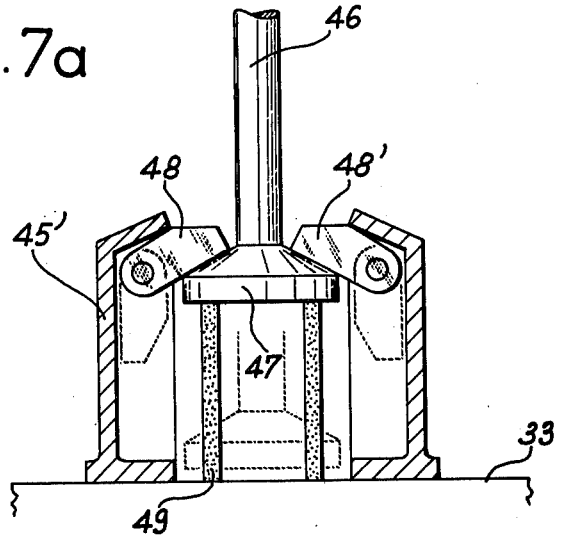
Figure 7B:
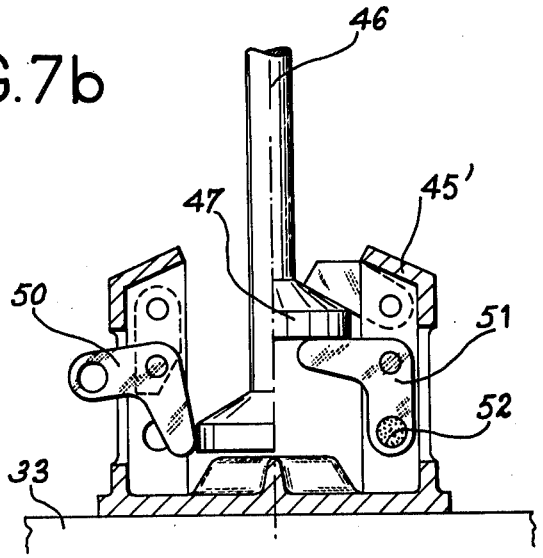

As shown in FIGS. 7*a* and 7*b*, the projecting portion 45 is provided with an end rod 46 having a base 47. The top face of said base is applied against two pawls 48 and 48' and the underface of said base is applied against a cylindrical support 49, said support being replaced in FIG. 7*b* by L-shaped keys 50 and 51. Prior to release of the sampler, the keys 50 and 51 are fixed in the position shown in FIG. 7*b* by means of a temporary-action locking-pin 52 made of sugar, for example, in order to prevent any opposition to the downward travel of the ballast under the action of its own inertia at the moment of contact with the sea floor.

Similarly, the support 49 is of the temporary-action type and is destroyed at the end of a predetermined period of immersion.

The duration of the downward displacement is longer than the time of destruction of said retaining members 49 or 50 and 51 in the top position of the devices attached to the base 47. It can be understood that, during this downward displacement and even after destruction of said retaining members, the position of the end rod 46 and base 47 remains unchanged, that is, applied against the abutment pawls 48, 48' under the action of the opposing forces exerted by the ballast 34 and the float 35. After landing on the sea bed, the base 47 continues its downward motion under the action of inertia, thereby releasing said abutment pawls 48 and 48' which are freely mounted on their pivot-pins. Said pawls accordingly perform a pivotal movement about said pins, free the top opening of the device 45 and allow the base 47 to pass through this latter, thus permitting the upward travel of the float.

It is apparent that, during this downward movement of the ballast which takes place after contact with the sea floor, the pawls 48 and 48' are no longer held in position as a result of destruction of the support 49 or of the locking-pin 52 under the effect of impact or dissolving in the water and they accordingly move downwards in rotation about their axes to the vertical position. There is then nothing to prevent upward displacement of the float since the ballast is thus released.

As is apparent from FIG. 5, the float 35 carries at the top end a control rod 53 for effecting the release of a tie-line 54 which maintains the end members 40 and 41 against each other after rotation about their pivot-pins 55 and 56 in opposition to the action of the springs 57 and 58. As a consequence, the articulated arms are both located externally of the assembly formed by the two vehicles at the time of downward travel.

Figure 6:
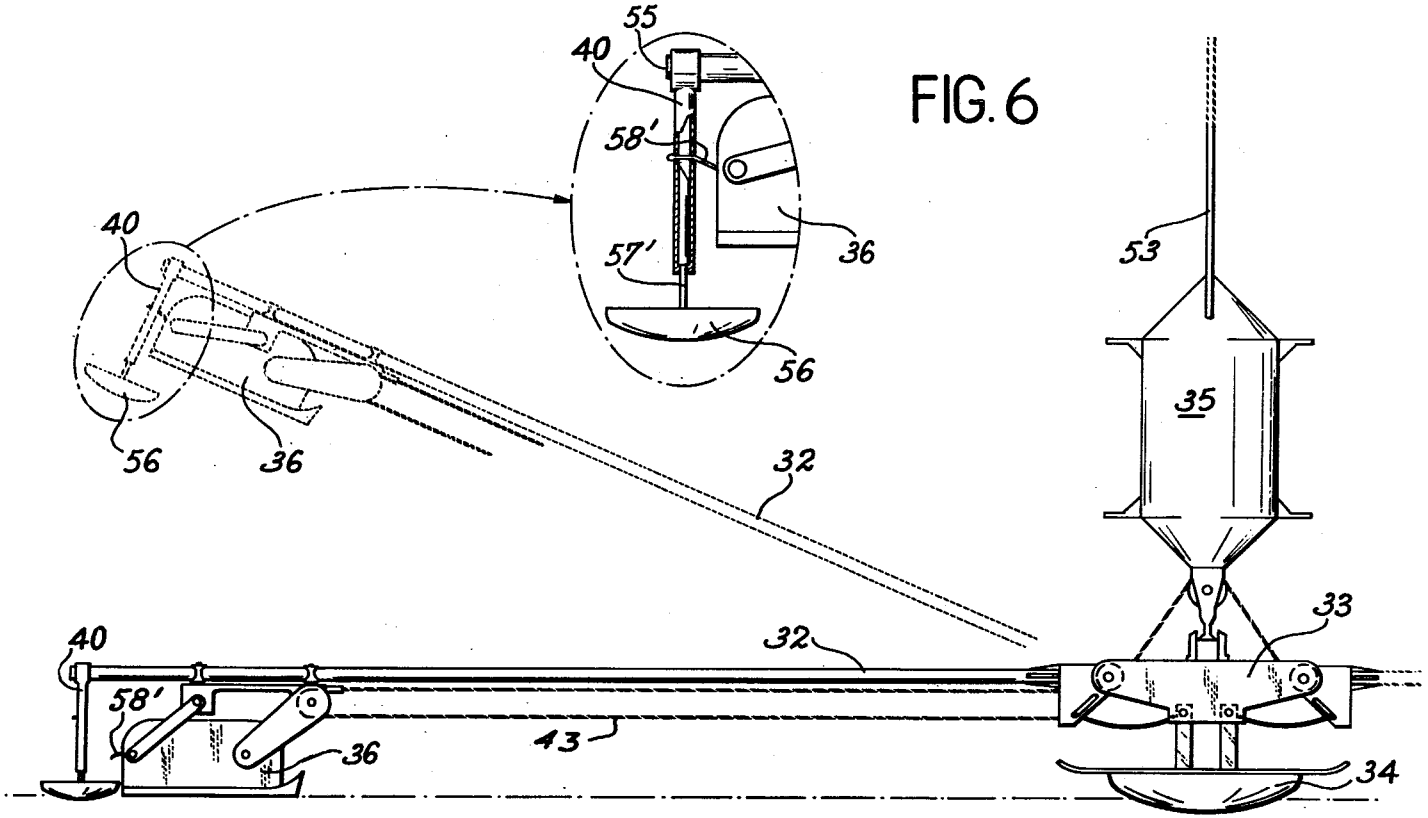

In FIG. 6, the articulated arm 32 is shown just as this latter is touching the sea floor, the end member 40 having carried out a movement of rotation about its pivot-pin 55 in order to direct its base 56 toward the sea floor, the stem 57 of the base 56 being intended to slide within the interior of the end member 40. The sharpened tip 57'' of the stem 57' acts in much the same manner as a knife-edge and this latter serves to cut the cable 58' which connects the vehicle 36 to the damping device as soon as the base 56 has touched the sea floor. Each vehicle is thus released with respect to the articulated arms.

The vehicle 36 is then capable of moving along the articulated arm 32 as a result of the tractive effort exerted by the cable which is drawn upwards by the float 35 as soon as this latter begins its movement of upward withdrawal.

In accordance with the preferred embodiment shown in FIGS. 8*a*, 8*b* and 9, the float 60 is provided with a plurality of compartments such as the compartment 61, each of which contains a hollow pressure-resistant glass sphere 62. It is noted that the articulated arms 31 and 32 are brought close together at their extremities in the closed position and that both vehicles are placed externally with respect to said arms.

Provision is made at the top of the float for a control rod 67 which is telescopic at 67' and serves to release the base 47 (as described earlier) as a result of extension under the action of inertia. Said control rod carries out unlocking of the articulated arms 31 and 32 which are released from the locking member 59 at the time of upward withdrawal of the float 60.

The float 60 is connected to the sampler frame 33 as in the previous example but use is made of a ballast 34' of improved design compared with the ballast 34. This ballast 34' essentially comprises a cylindrical body 65 surrounded by a cylindrical shell 66 which is rigidly fixed to a flat annular member 66' having the intended function both of preventing excessive penetration of the ballast and of ensuring stability of this latter. The top frame can advantageously be equipped with photographic and motion-picture apparatus for supplying valuable information on the nature of ocean beds under exploration and on the operation of the samplers. Provision is made on the articulated arms and in the vicinity of the support frame 33 for stops 53 which prevent the vehicles from striking the annular member 66'.

Each vehicle 36 or 37 is guided as it travels along the articulated rods 31 and 32 by means of a suitable system of roller-bearings.

It is worthy of note that, as a safety precaution in the event that the ballast is not jettisoned, provision has accordingly been made for electrolytic locking-ins 74 (shown in FIG. 5) which can be destroyed under the action of sea water. In the majority of instances, said locking-pins consist of a magnesium rod surrounded by a stainless steel electrode. The sea water causes the formation of an electrolytic couple which destroys the magnesium and results in breaking of the connection between the ballast and the sampler frame.

In the embodiment shown in FIGS. 8*a* and 8*b*, provision is again made for electrolytic locking-pins (not shown) between the ballast 34' and the frame 33.

The sampler frame has been equipped with an apparatus (not shown in the drawings) comprising a programmer which controls in particular the release of the ballast as well as various measuring or recording instruments which serve to determine the speed of rotation of the pulleys, the speed of the collecting vehicles, the tractive force applied on the cables.

The operation of the collecting vehicles takes place as described with reference to FIGS. 2*a*, 2*b*, 3*a* and 3*b* in regard to traction of the collecting vehicle or vehicles and driving of the device which provides mechanical assistance for the collecting operation in the form of a blade wheel or a blade-type conveyor-belt.

There is shown in FIGS. 10*a*, 10*b*, 11, 12 and 13 an alternative embodiment of the collecting unit or free sampler as illustrated in different forms in the previous figures and closely related to the preferred structure shown in FIG. 8. In this alternative embodiment, the float which has been released from the ballast-pile causes the movement of rotation of one or both articulated arms 100-(101) which carry the collecting vehicles 36, 37 at the ends thereof. Said vehicles operate at a constant distance from the axis of rotation and follow a circular path.

FIGS. 10*a* and 11 are transverse part-sectional views of the collecting unit in accordance with the third embodiment aforementioned. The articulated arm 100 is extended in the collecting position. The assembly is again provided with a ballast in the form of an anchoring pile 5, a separable frame 33 with safety locking-pin 74 on which are mounted all the mechanisms constituting the collecting system and a float 35. A rotating portion or annular member 83 is placed around the frame 33 and at least one articulated arm 100 is pivotally mounted on said annular member. The arm 100-(101) is in the vertical position during downward travel and carries out a pivotal movement in the vicinity of the horizontal position at the time of landing on the sea floor as in the second embodiment. Said articulated arm or arms are driven in a movement of rotation about the vertical axis of the unit by means of the cable 84, the tractive effort of which attains the necessary value by means of the multiplying reeve 81, the length of which is compatible with the necessary length of winding on the capstan 85 located at the top portion of the pivotal annular member 83.

The displacement of the movable pulley 80 causes the displacement of the cable 84' which is initially wound onto the capstan 85 whilst unwinding of the cable 84' in turn initiates the rotation of the annular member 83 when this latter has been released from the frame 33.

It is thus apparent that only one of the reeves aforementioned is capable of initiating displacement of one or two articulated arms such as the arms 100-(101) which are attached to the annular member 83 in a movement which consists of one half-revolution if there are two arms or one revolution if there is only one arm. It can readily be understood that the length required for the arm or arms such as those designated by the reference 100 is considerably shorter than that of the arms 31 (and 32) which, in this third embodiment and as shown in FIG. 13, form an extension arm or extension arms in order to ensure that the float is correctly housed above the reeve 80. There are associated with the float at the lower end the system for locking and releasing the base 47 as shown in FIGS. 7*a* and 7*b* and, at the upper end, the system for releasing the arms by means of the extension arm or arms 31 and 32. The device can be the same as that shown in FIGS. 8 and 9. FIG. 13 shows the complete unit which is mounted in the downward-travel position.

FIG. 10*b* additionally illustrates the details relating to the releasing of the collecting vehicle such as the vehicle 37.

The arm is equipped with a release-control device of the type shown in FIG. 6. In the third embodiment, this release-control device carries out two operations:

(1) cutting of the cable 58' for maintaining the collecting vehicle 37 in the top position, said vehicle (as shown in full lines in FIG. 10*b*) being connected to the articulated arm 100 by means of a deformable parallelogram (link-arms 90). This is achieved by means of the sharpened portion 57'' of the stem 57' of the base 56. The vehicle 57 is thus capable of travelling along its circular path while remaining applied against the sea floor;

(2) release of the annular member 83 for rotational motion. The stem 57' produces action on the reversing member 98 which is pivotally mounted on the shaft 99 (see FIG. 10*b*). The reversing member lifts the catch 89' which thus releases the rod 86. Said rod is displaced towards the left-hand side of FIG. 10*a* under the action of the spring 87. The end of the rod 86 is applied against the heel of the catch 96. The annular member 83 is thus released and driven in rotation under the action of upward withdrawal of the float.

In FIG. 11, the cable 84 is secured to the float 35 which has been shown only diagrammatically. It is readily apparent that this float preferably has the shape shown at 60 in FIG. 8*b*. Similarly, this figure does not illustrate the device 45, 46, 47 for locking and releasing the float as well as the member 59 for locking the articulated arms together with its control rod 67. These elements are all visible in FIG. 13 in a simplified form.

Moreover, the rotation of the shaft 14 for driving the system which provides mechanical assistance for the collecting operation in the manner described in FIGS. 2 and 3 is carried out by means of the cable 89. The transmission pulleys 91, 92, 93 serve to carry said cable 89 to the pivot-pin of the articulated arm on which is mounted a final transmission pulley 94, then to a point of attachment on a large fixed pulley 95 which is rigidly fixed to the upper releasable platform 33. It is thus apparent that, during pivotal motion of the arm 100, winding of the cable onto said fixed capstan 95 causes the rotation of the collection-assisting blades. This figure does not show in detail whether there is one arm which performs nearly one revolution, two diametrically opposite arms which perform one half-revolution, or two arms which rotate in opposite directions and each perform nearly one revolution if their diameter of action is slightly different or each perform one half-revolution in order to meet at the point which is diametrically opposite to their starting point. All these alternative forms can readily be deduced from the details given in FIG. 10. In regard to the different release and safety systems, especially for jettisoning the upper platform 33 at the end of an operation and abandoning of the ballast 5, these can readily be deduced from the preceding figures.

FIG. 12 illustrates the arm 100 in the raised position and shows the mode of action of the catch 96 which ensures that the extension arms 32 are locked rotationally with respect to the frame of the collecting unit.

In the embodiment shown in FIGS. 10 to 13, the upward movement of the float 35 is converted to a movement of rotation of the pivotal annular member 83 by means of a set of cables, reeves, pulleys and capstans. It will readily be understood that this assembly for the conversion of the direction of displacement could be constituted, for example, by a gear-train which replaces the pulleys, the input pinion being associated with a drum which is in turn driven by the cable attached to the float 35. Similarly, provision can be made for a multiplying reeve on the cable 89 in order to ensure that the diameters of the capstans 14 and 95 can be made compatible with each other.

What we claim is:

1. An independent unit for the collection and upward transfer of nodules resting on an underwater bed, wherein said unit comprises:

at least one collecting vehicle for collecting said nodules, said vehicle being adapted to be displaced on and along said underwater bed, at least one ballast including means for anchoring the ballast in the underwater bed, flotation means, at least one means for conversion of the direction of displacement of said at least one vehicle with respect to said flotation means, said flotation means being secured to the end of at least one cable, the other end of said at least one cable being intended to exert a tractive effort on said at least one vehicle by means of a transmission element and said conversion means being in cooperating relation with said at least one cable in order to convert the upward motion of said flotation means to a displacement of said at least one vehicle along the sea floor, said means being secured to said ballast and detachable therefrom, means for securing the assembly constituted by the flotation means, the ballast, said conversion means and said at least one vehicle, until said assembly reaches the underwater bed, means for detaching said flotation means from the ballast when said ballast has reached the sea floor, means rigidly fixed to said at least one vehicle and to said flotation means for causing said at least one vehicle to land on the underwater bed at predetermined point with respect to the point of landing of said ballast, said predetermined point being separated from said point of landing of said ballast, and means for detaching said at least one vehicle and said conversion means from said ballast.

2. An independent unit for the collection and upward transfer of nodules resting on an underwater bed, wherein said unit comprises:

at least one collecting vehicle for collecting said nodules, said vehicle being adapted to be displaced on and along said underwater bed, at least one ballast including means for anchoring the ballast in the underwater bed, flotation means, at least one means for conversion of the direction of displacement of at least one vehicle with respect to said flotation means, said flotation means being secured to the end of at least one cable, the other end of said at least one cable being intended to exert a tractive effort on said at least one vehicle by means of a transmission element and said conversion means being in cooperating relation with said at least one cable in order to convert the upward motion of said flotation means to a displacement of said at least one vehicle along the sea floor, said means being secured to said ballast and detachable therefrom, means for securing the assembly constituted by the flotation means, the ballast, said conversion means and said at least one vehicle until said assembly reaches the underwater bed, means for detaching said flotation means from the ballast when said ballast has reached the sea floor, means rigidly fixed to said at least one vehicle and to said flotation means for causing said at least one vehicle to land on the underwater bed at predetermined point with respect to the point of landing of said ballast, said predetermined point being separated from said point of landing of said ballast, and means for detaching said at least one vehicle and said conversion means from at least one said ballast, said ballast being fitted with an anchoring pile comprising said means for anchoring, said unit including a removable platform connected to said ballast by controllable coupling means, at least one pulley rigidly fixed to said platform and over which said cable passes, said cable being attached at one end to said flotation means and at the other end to said platform, said cable being also passed over a pulley mounted on said at least one vehicle after passing over said pulley which is rigidly fixed to said platform, and retractable means for securing said cable to said flotation means near the point of passage over the pulley which is rigidly fixed to the vehicle, said means being retracted as said ballast comes into contact with the underwater bed.

3. A unit according to claim 2, wherein said at least one vehicle includes ballasting means such that the center of gravity of said at least one vehicle is located beneath the center of buoyancy of said at least one vehicle.

4. An independent unit for the collection and upward transfer of nodules resting on an underwater bed, wherein said unit comprises:

at least one collecting vehicle for collecting said nodules, said vehicle being adapted to be displaced on and along said underwater bed, at least one ballast including means for anchoring the ballast in the underwater bed, flotation means, at least one means for conversion of the direction of displacement of at least one vehicle with respect to said flotation means, said flotation means being secured to the end of at least one cable, the other end of said at least one cable being intended to exert a tractive effort on said at least one vehicle by means of a transmission element and said conversion means being in cooperating relation with said at least one cable in order to convert the upward motion of said flotation means to a displacement of said at least one vehicle along the sea floor, said means being secured to said ballast and detachable therefrom, means for securing the assembly constituted by the flotation means, the ballast, said conversion means and said at least one vehicle until said assembly reaches the underwater bed, means for detaching said flotation means from the ballast when said ballast has reached the sea floor, means rigidly fixed to said at least one vehicle and to said flotation means for causing said at least one vehicle to land on the underwater bed at predetermined point with respect to the point of landing of said ballast, said predetermined point being separated from said point of landing of said ballast, and means for detaching said at least one vehicle and said conversion means from at least one said ballast, said at least one ballast being fitted with an anchoring pile comprising said means for anchoring, said unit including a removable platform connected to said ballast by controllable coupling means, at least one arm pivotally mounted at one end thereof on said platform, means for causing said at least one arm to swing from a vertical position to a horizontal position as soon as the ballast has come to rest on the underwater bed, means for guiding said at least one vehicle along said at least one arm from the opposite end thereof, means for releasing the flotation means with respect to said platform, said at least one cable being attached at both ends to said platform and passed over a pulley secured to the flotation means and over a pulley mounted on said at least one vehicle.

5. An independent unit for the collection and upward transfer of nodules resting on an underwater bed, wherein said unit comprises:

at least one collecting vehicle for collecting said nodules, said vehicle being adapted to be displaced on and along said underwater bed, at least one ballast including means for anchoring the ballast in the underwater bed, flotation means, at least one means for conversion of the direction of displacement of at least one vehicle with respect to said flotation means, said flotation means being secured to the end of at least one cable, the other end of said at least one cable being intended to exert a tractive effort on said at least one vehicle by means of a transmission element and said conversion means being in cooperating relation with said at least one cable in order to convert the upward motion of said flotation means to a displacement of said at least one vehicle along the sea floor, said means being secured to said ballast and detachable therefrom, means for securing the assembly constituted by the flotation means, the ballast, said conversion means and said at least one vehicle until said assembly reaches the underwater bed, means for detaching said flotation means from the ballast when said ballast has reached the sea floor, means rigidly fixed to said at least one vehicle and to said flotation means for causing said at least one vehicle to land on the underwater bed at predetermined point with respect to the point of landing of said ballast, said predetermined point being separated from said point of landing of said ballast, and means for detaching said at least one vehicle and said conversion means from at least one said ballast, said one ballast being fitted with an anchoring pile comprising said means for anchoring, said unit including a removable platform connected to said ballast by controllable coupling means, a member which is freely rotatable about the vertical axis of said removable platform, at least one arm pivotally mounted on said member, said at least one vehicle being rigidly fixed to the end of said at least one arm, means for causing said at least one arm to swing from a vertical position to a horizontal position as soon as the ballast has come to rest on the underwater bed, said cable being attached at one end to said flotation means and at the other end to said platform, said cable being passed over a reeve comprising at least one movable pulley, and means for coverting the upward movement of said pulley to a movement of rotation of said member about the vertical axis thereof.

6. A unit according to claim 5, including at least one second cable in which one end of said second cable is secured to a pulley mounted on said at least one vehicle and the other end is secured to a pulley mounted on the platform.

7. A unit according to any one of claims 2 or 3 or 4 or 5 or 6, wherein said at least one vehicle includes a body, a zone for storage of collected sediments within said body, collecting combs fixed on an opening located in front of the body and between said combs and said storage zone, a wheel having flexible spikes mounted on a horizontal shaft, said shaft being rigidly fixed to the pulley which is mounted on said at least one vehicle.

* * * * *